US006352337B1

(12) United States Patent
Sharma

(10) Patent No.: US 6,352,337 B1
(45) Date of Patent: Mar. 5, 2002

(54) ASSISTED DROP-ON-DEMAND INKJET PRINTER USING DEFORMABLE MICRO-ACUATOR

(75) Inventor: Ravi Sharma, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/708,354

(22) Filed: Nov. 8, 2000

(51) Int. Cl.[7] ..... B41J 2/05
(52) U.S. Cl. ..... 347/56; 347/65; 347/67
(58) Field of Search ..... 347/54, 56, 63, 347/65, 61, 94, 55, 68, 71, 67; 337/139, 140, 141; 251/129.01, 129.02

(56) References Cited

U.S. PATENT DOCUMENTS

| | | | | |
|---|---|---|---|---|
| 2,896,507 A | | 7/1959 | Mast et al. | 359/292 |
| 3,716,359 A | | 2/1973 | Sheridon | 430/19 |
| 4,065,308 A | | 12/1977 | Bergen | 430/50 |
| 4,163,667 A | | 8/1979 | Wysocki | 430/67 |
| 4,646,106 A | | 2/1987 | Howkins | 347/9 |
| 5,495,280 A | | 2/1996 | Gehner et al. | 347/258 |
| 5,619,177 A | * | 4/1997 | Johnson et al. | 337/140 |
| 5,726,693 A | * | 3/1998 | Sharm et al. | 347/48 |
| 5,739,832 A | * | 4/1998 | Heinzl et al. | 347/68 |
| 5,764,258 A | | 6/1998 | Hetzer et al. | 347/85 |
| 5,812,159 A | * | 9/1998 | Anagnostopoulos et al. | 347/55 |
| 5,825,275 A | * | 10/1998 | Wuttig et al. | 337/139 |
| 5,867,301 A | | 2/1999 | Engle | 359/291 |

FOREIGN PATENT DOCUMENTS

| | | | |
|---|---|---|---|
| WO | WO 99/17083 | 4/1999 | G01D/15/06 |

OTHER PUBLICATIONS

USSN 09/671,438 entitled Deformable Micro–Actuator, by Ravi Sharma et al., filed Sep. 27, 2000.

* cited by examiner

*Primary Examiner*—John Barlow
*Assistant Examiner*—Juanita Stephens
(74) *Attorney, Agent, or Firm*—Milton S. Sales

(57) ABSTRACT

A droplet generator is provided that is particularly adapted for generating micro droplets of ink on demand in an inkjet print head having a plurality of nozzles. The droplet generator includes a droplet separator formed from the combination of a droplet assistor and a droplet initiator. The droplet assistor is coupled to ink in each of the nozzles and functions to lower the amount of energy necessary for an ink droplet to form and separate from an ink meniscus extending across the nozzle outlet. The droplet assistor may be, for example, a heater or surfactant supply mechanism for lowering the surface tension of the ink meniscus. Alternatively, the droplet assistor may be a mechanical oscillator such as a piezoelectric transducer that generates oscillations in the ink sufficient to periodically form convex ink menisci across the nozzle outlets, but insufficient to cause ink droplets to separate from the outlets. The droplet initiator cooperates with the droplet assistor and selectively causes an ink droplet to form and separate from the ink meniscus. The droplet initiator may be, for example, a thermally-actuated paddle. The droplet separator increases the speed and accuracy of ink micro droplets expelled from the print head nozzles.

11 Claims, 3 Drawing Sheets

ASSISTED DROP-ON-DEMAND INKJET PRINTER USING DEFORMABLE MICRO-ACUATOR

CROSS REFERENCE TO RELATED APPLICATIONS

Reference is made to commonly assigned, co-pending patent applications Ser. No. 09/671,438 entitled DEFORMABLE MICROACTUATOR filed Sep. 27, 2000, and Serial No. entitled DEFORMABLE MICRO-ACTUATOR WITH GRID ELECTRODE filed concurrently herewith.

FIELD OF THE INVENTION

This invention generally relates to a drop-on-demand inkjet printer having a droplet separator that includes a mechanism for assisting the selective generation of micro droplets of ink.

BACKGROUND OF THE INVENTION

Inkjet printing is a prominent contender in the digitally controlled electronic printing arena because, e.g., of its non-impact, low-noise characteristics, its use of plain paper, and its avoidance of toner transfers and fixing. Inkjet printing mechanisms can be categorized as either continuous inkjet or drop-on-demand inkjet. Drop-on-demand inkjet printers selectively eject droplets of ink toward a printing media to create an image. Such printers typically include a print head having an array of nozzles, each of which is supplied with ink. Each of the nozzles communicates with a chamber which can be pressurized in response to an electrical impulse to induce the generation of an ink droplet from the outlet of the nozzle. Many such printers use piezoelectric transducers to create the momentary pressure necessary to generate an ink droplet. Examples of such printers are present in U.S. Pat. Nos. 4,646,106 and 5,739,832.

While such piezoelectric transducers are capable of generating the momentary pressures necessary for useful drop-on-demand printing, they are relatively difficult and expensive to manufacture since the piezoelectric crystals (which are formed from a brittle, ceramic material) must be micromachined and precision installed behind the very small ink chambers connected to each of the inkjet nozzles of the printer. Additionally, piezoelectric transducers require relatively high voltage, high power electrical pulses to effectively drive them in such printers.

To overcome these shortcomings, drop-on-demand printers utilizing thermally-actuated paddles have been suggested. Each paddle would include two dissimilar metals and a heating element connected thereto. When an electrical pulse is conducted to the heating element, the difference in the coefficient of expansion between the two dissimilar metals causes them to momentarily curl in much the same action as a bimetallic thermometer, only much quicker. A paddle is attached to the dissimilar metals to convert momentary curling action of these metals into a compressive wave which effectively ejects a droplet of ink out of the nozzle outlet.

Unfortunately, while such thermal paddle transducers overcome the major disadvantages associated with piezoelectric transducers in that they are easier to manufacture and require less electrical power, they do not have the longevity of piezoelectric transducers. Additionally, thermal paddle transducers are prone to attracting dye deposit due to heat used in actuation. The dynamic response characteristics of the paddle will alter as dye deposit builds making the paddle unreliable for reproducible ink drop generation. Thermal paddle transducers therefore are preferably used with specially formulated inks that have additives to minimize heat-induced deposition and/or have lower dye content.

DISCLOSURE OF THE INVENTION

It is an object of the present invention to provide an improved drop-on-demand type printer which utilizes paddles, but which is capable of ejecting ink droplets at higher speeds and with greater power to enhance printing accuracy and reliable drop ejection, and to render the printer compatible with inks of greater viscosity and dye content.

According to a feature of the present invention, a drop-on-demand inkjet print head includes a nozzle with an ink outlet, an ink supply channel through which a body of ink is supplied to the nozzle, and a member movable in the ink supply channel toward the nozzle outlet for causing a droplet to separate from the body of ink. A micro-actuator applies a mechanical force to the member. The micro-actuator includes a body of elastomer material having opposed first and second surfaces spaced apart in a first direction by a predetermined at-rest dimension. A charge mechanism is coupled to the first opposed surface of the elastomer material so as to apply an electrical charge in the first direction. The charge is spatially varied in a second direction substantially normal to the first direction so as to create spatially varied mechanical forces across the elastomer material such that the elastomer material exhibits spatially varied growth in the first direction. The member is associated with the second opposed surface of the elastomer material so as to move in the first direction in response to growth of the elastomer material.

The invention, and its objects and advantages, will become more apparent in the detailed description of the preferred embodiments presented below.

DETAILED DESCRIPTION OF THE INVENTION

Figure 1:
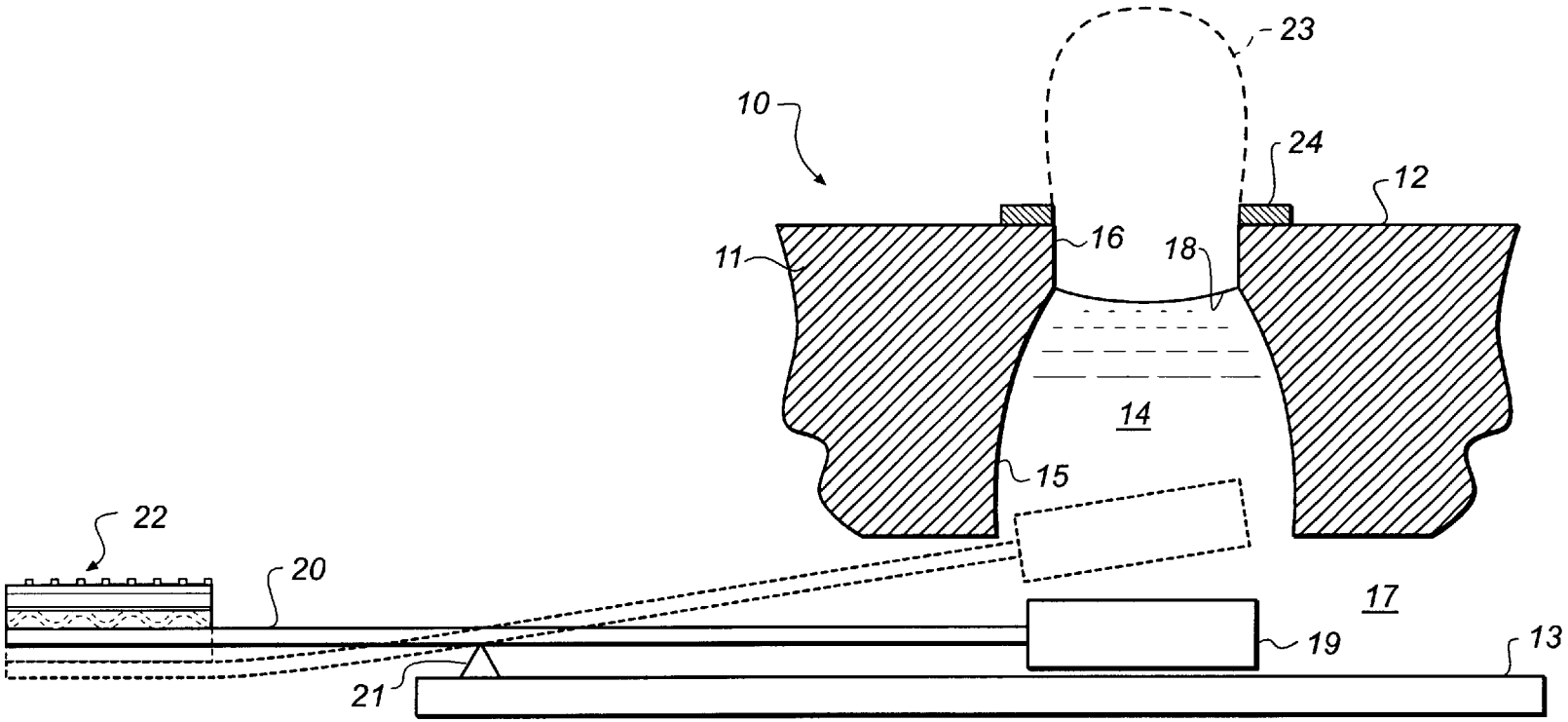
FIG. 1 is a cross-sectional side view of a nozzle in a drop-on-demand print head that utilizes a micro-actuated paddle in each nozzle to generate and eject ink droplets.

With reference now to FIG. 1, a print head 10 generally comprises a front substrate 11 having an outer surface 12 and a back substrate 13. A plurality of nozzles 14 (only one shown) are disposed through substrate 11. Each nozzle has lower, tapered side walls 15, and upper cylindrical side walls 16. An ink conducting channel 17 is provided between substrates 11 and 13 for providing a supply of liquid ink to the nozzles.

Liquid ink forms a concave meniscus 18 around upper side walls 16 that define the nozzle outlet. Each nozzle 14 is provided with a member such as a mechanically-actuated paddle 19 in FIG. 1 directly below nozzle 14. The paddle is carried at one end of a cantilever beam 20 resting on a fulcrum 21. One skilled in the art will understand that the apparatus illustrated in the drawings is schematic in nature and that any pivotating mechanism may be used to support fulcrum 21.

The other end of fulcrum 21 abuts a micro-actuator 22 which, as explained in detail below, can be caused to suddenly expand to push the end of cantilever beam 20 downwardly as illustrated in phantom lines in FIG. 1. Cantilever beam pivots about fulcrum 21, causing paddle 19 to move sharply upwardly toward nozzle 14. The shockwave that the motion of the paddle 19 transmits to the liquid ink inside nozzle 14 results in the formation and ejection of a micro droplet 23 of ink (shown in phantom) from print head 10.

It may be found that paddle 19 generally does not eject micro droplets 23 with sufficient speed and accuracy toward a printing medium (not shown). With that in mind, an optional droplet assistor, illustrated as an annular heating element 24 that closely circumscribes nozzle 14, has been provided. Such a heating element may easily be integrated onto outer surface 12 of the print head by way of CMOS technology. When an electrical pulse is conducted through annular heating element 24, a momentary heat pulse reduces the surface tension of the ink in the vicinity of meniscus 18. Such heaters and the circuitry necessary to drive them are disclosed in commonly assigned U.S. Pat. No. 6,079,821 Oct. 17, 1997. While optional droplet assistor is illustrated as annular heating element 24, it could for example be a surfactant supplier that operates to lower the surface tension of ink in the meniscus; or a combination of a heater and a surfactant supplier.

In operation, micro droplets of ink are generated by simultaneously expanding micro-actuator 22 and activating heating element 24. Hence, paddle 19 immediately moves sharply into the position indicated in phantom while the heat pulse generated by annular heating element 24 lowers the surface tension of the ink in meniscus 18. The end result is that an ink droplet is expelled at a high velocity from the nozzle.

As way of example, the following configuration would produce a 3 picoliter droplet. Assuming that the diameter of paddle 19 is 30 $\mu$m and cantilever beam 20 is 200 $\mu$m long, when fulcrum 21 is 20 $\mu$m from the paddle end, a 0.05 $\mu$m movement causes paddle 19 to move 4.5 $\mu$m in the ink chamber. This produces a droplet slightly larger than 3 picoliters.

Figure 2:
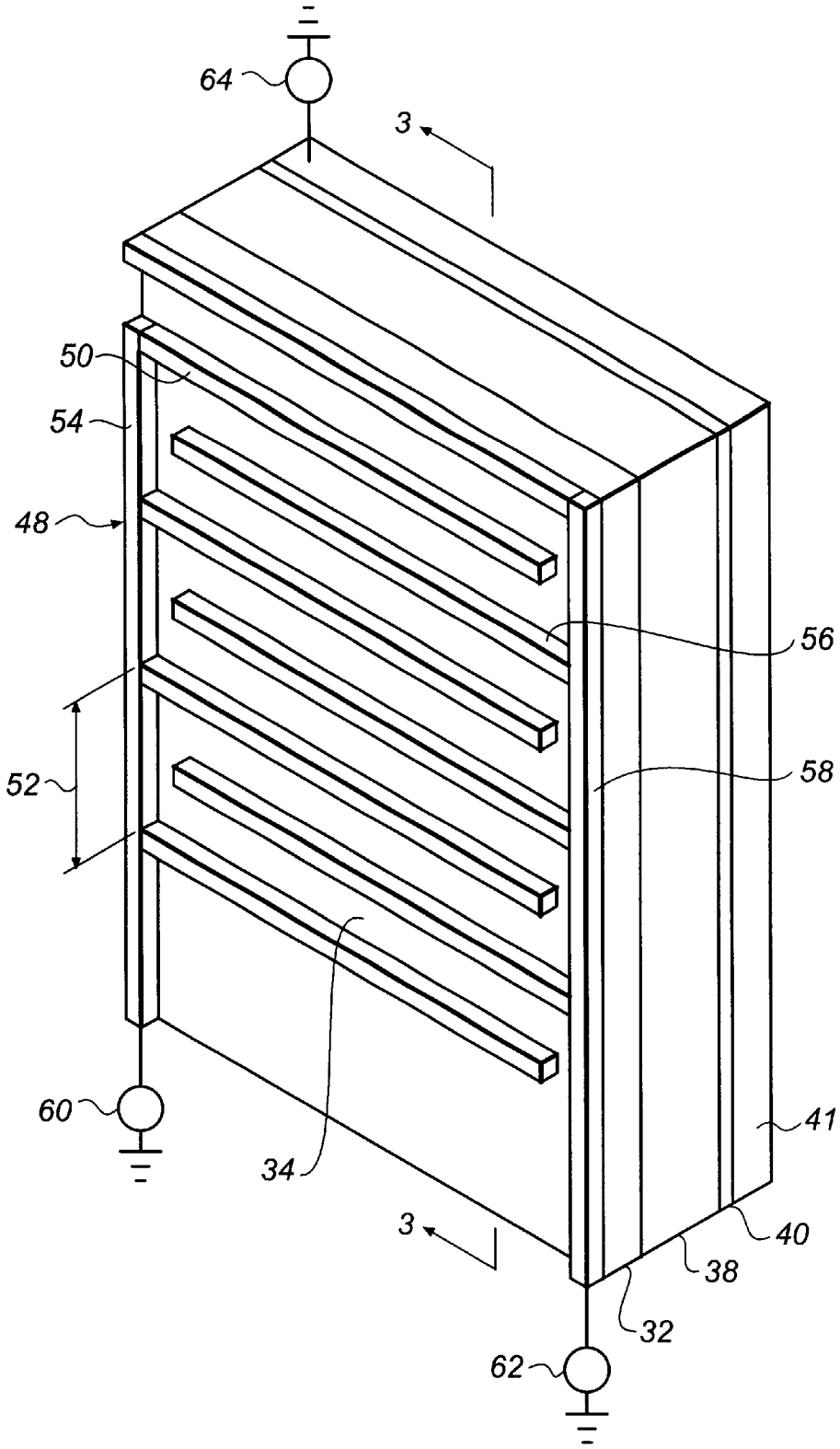
FIG. 2 is a schematic perspective view of a portion of a microactuator according to the present invention.
Figure 3:
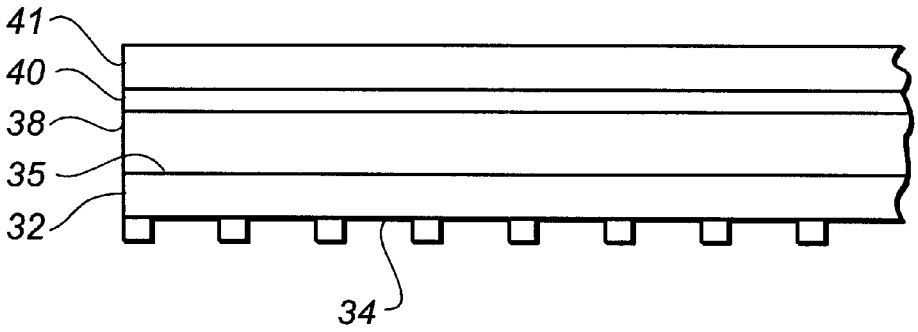
FIG. 3 is a cross-sectional view of the micro-actuator of FIG. 1.

Referring to FIGS. 2 and 3, a micro-actuator usable in the present invention includes a support substrate 32 having a first surface 34 and a second surface 35. Surfaces 34 and 35 of substrate 32 are essentially parallel planes separated by the thickness of substrate 32. The second surface of substrate 32 carries a body 38 of defonnable elastomer material. Substrate 32 is stationary and establishes a rigid mechanical boundary with defonnable elastomer body 38 at their interface. An electrically conductive flexible electrode plate 40 is attached to elastomer body 38. A rigid, essentially non-deformable member 41 overlies electrode plate 40, but is not attached to the electrode plate.

Affixed to first surface 34 of substrate 32 is a grille electrode structure 48. Structure 48 further includes a plurality of first conductive fingers 50. Adjacent fingers 50 are displaced by a first period 52. First period 52 is perpendicular to the thickness between the first and second surfaces of substrate 32. The drawings show grille electrode structure 48 on the outer surface of support substrate 32. Persons skilled in the art will understand that electrode structure may be attached to the inner surface of support substrate 32 so as to extend into elastomer body 38.

Fingers 50 are electrically connected by a first buss 54. Structure 48 further includes a plurality of second conductive fingers 56. Adjacent fingers 56 are displaced by period 52. Fingers 56 are electrically connected by a second buss 58. Fingers 50 and fingers 56 are interwoven to create grille electrode structure 48.

First buss 54 is electrically connected to a first voltage source 60. Second buss 58 is electrically connected to a second voltage source 62. Conductive metallic electrode plate 40 is electrically connected to a third voltage source 64. As well understood by those knowledgeable in the state of the art, electrically connecting first buss 54 and second buss 58 to respective voltage sources and applying a voltage to conductive metallic electrode plate 40 allows a periodic electric field to be established in deformable elastomer body 38. Polarity and magnitude of the voltage sources are selected to be compatible with the resolution and speed of response requirements for the application under consideration.

Figure 4:
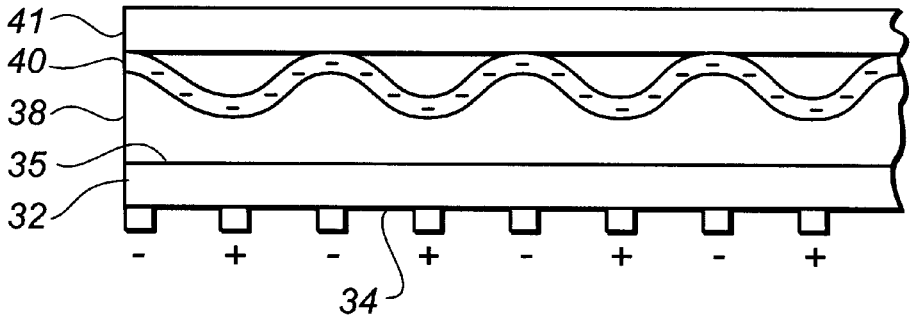
FIG. 4 is a cross-sectional view similar to FIG. 2, showing the micro-actuator in another state.
Figure 5:
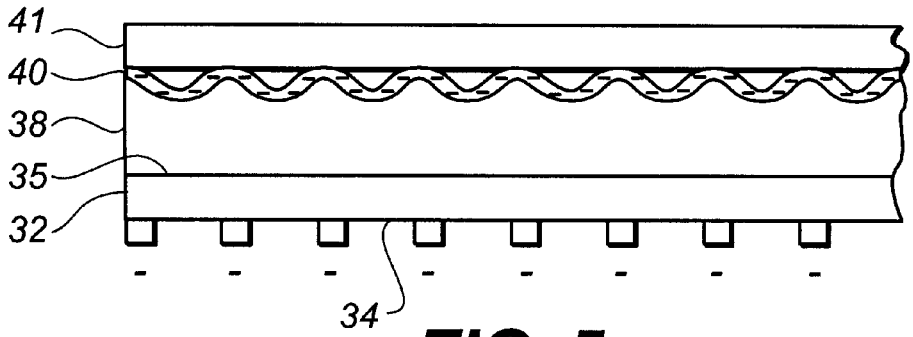
FIG. 5 is a cross-sectional view similar to FIGS. 2 and 3, showing the micro-actuator in still another state.

In operation, an electric field is established across defonnable elastomer body 38 in a direction normal the planes of electrode structure 48 and electrode plate 40 by applying potential from sources 60 and 62 to busses 54 and 58, respectively. If the polarity of the grille electrode fingers and electrode plate 40 is different, the mechanical force of attraction between a finger and electrode plate 40 due to the electric field causes deformable elastomer layer to locally compress. Of course, a finger and electrode plate 40 will repulse and cause the elastomer layer to locally deform in expansion if like electrical poles are applied to a finger and electrode plate 40. FIG. 4 shows the situation where the polarities of sources 60 and 62 are different. Every other finger 50, 56 carries an opposite charge. Electrode plate 40 is alternately repelled and attracted to busses 54 and 58. In contrast, FIG. 5 shows the situation where the polarities of sources 60 and 62 are the same, and are the same as that of electrode plate 40. Each finger 50, 56 repels an associated portion of electrode plate 40.

As the body of elastomer material locally compresses and expands due to inhomogeneous spatially varied mechanical forces across the body, a ripple effect occurs at its surface. The thickness variations result in localized growth of the body, pushing rigid member 41 upwardly as shown in the drawings. Such movement can be used to actuate varies mechanisms as desired.

Deformable elastomer body 38 may comprise any suitable elastomer material, such as for example natural rubber or synthetic polymers with rubber-like characteristics (silicone rubber, styrenebutadiene, polybutadiene, neoprene, butyl, polyisoprene, nitrile, urethane, polydimethylsioxane, and ethylene rubbers). Elastomers having relatively high dielectric strength will allow the devices to be operated at higher voltage levels, which in many instances may be preferred.

Suitable selection of a particular elastomer material which exhibits an elastic modulus appropriate for a predetermined intended use is within ordinary skill given the description herein. For example, a relatively more stiff elastomer will typically recover more rapidly when an electric field is removed. On the other hand, an elastomer material having a relatively low elastic modulus is typically capable of greater deformations for a given value of electric field. The strain is negative indicating a compressive deformation.

Electrode plate 40 should have good lateral conductivity, excellent stability, and little internal stress; as well as being highly adherent to deformable elastomer body 38. Suitable materials for electrode plate 40 include gold, silver, chromium, nickel, aluminum, conducting polymer, etc. Electrode plate 40 may be formed such as by chemical reaction, precipitation from a solution, electrophoresis, electrolysis, electroless plating, vapor deposition and others. The thickness of electrode plate 40 may, for example, be in the range of from about 200 angstroms to about 5,000 angstroms depending upon any desired flexibility, and the requisite strength and conductivity.

Inhomogeneous electric fields will lead to electrostatic forces on deformable elastomer body 38. Inhomogeneous electric fields in deformable elastomer body 38 are related to the electrostatic forces applied to conductor 40. As previously identified, conductor 40 is carried by the second surface of deformable elastomer body 38. Varying electrostatic forces applied to conductor 40 varies deformation of the second surface of deformable elastomer body 38. As previously identified, the first surface of deformable elastomer body 38 is stationary and deformations of the second surface of deformable elastomer body 38 lead to thickness variations in deformable elastomer body 38. Thickness of deformable elastomer body 38 is utilized to characterize variations in separation between the first surface of deformable elastomer body 38 and its second surface.

The invention has been described in detail with particular reference to preferred embodiments thereof, but it will be understood that variations and modifications can be effected within the spirit and scope of the invention. By way of example, a preferred form of micro-actuator 22 has been illustrated, but it will be understood that the micro-actuator may take any of several known forms.

What is claimed is:

1. An inkjet print head particularly adapted for generating micro-droplets on demand, said print head comprising:

a nozzle with an ink outlet;

an ink supply channel through which a body of liquid ink is supplied to said nozzle;

a member in the ink supply channel and movable in a direction toward the nozzle outlet for causing an ink droplet to separate from said body of ink; and a micro-actuator for applying a mechanical force to said member, said micro-actuator comprising:

a body of deformable elastomer material having opposed first and second surfaces spaced apart in a first direction by a predetermined at-rest dimension, and a charge mechanism coupled to said first opposed surface of said body of deformable elastomer material, said charge mechanism being adapted to apply an electrical charge across said body of deformable elastomer material in said first direction, said charge being spatially varied in a second direction substantially normal to said first direction so as to create spatially varied mechanical forces across the body of deformable elastomer material such that said body of deformable elastomer material exhibits spatially varied growth in said first direction, said member being associated with the second opposed surface of the body of deformable elastomer material so as to move in said first direction in response to growth of the body of defonnable elastomer material.

2. An inkjet print head as defined in claim 1, wherein said member comprises a mechanically-actuated paddle.

3. An inkjet print head as defined in claim 2, wherein said member comprises a beam supporting said mechanically-actuated paddle, wherein a force applied to the beam is transmitted to the paddle.

4. An inkjet print head as defined in claim 3, wherein said beam has two opposed ends and is supported for rotation about a position intermediate its ends, said paddle being on one side of the support position and said micro-actuator being on the other side of said support position.

5. An inkjet print head as defined in claim 1, wherein the charge mechanism comprises a grille electrode connectable to an electrical potential source so as to establish said spatially varied electrical charge.

6. An inkjet print head as defined in claim 5, wherein the charge mechanism further comprises an electrically conductive flexible layer on said second surface between said second surface and said rigid member, said flexible layer being connectable to an electrical potential source so as to induce a force between the flexible layer and said grille electrode upon application of an electrical field.

7. An inkjet print head as defined in claim 5, further comprising a stationary rigid substrate between the first surface and said grille electrode to establish a rigid mechanical boundary at the first surface.

8. An inkjet print head as defined in claim 5, wherein said grille electrode comprises a plurality of conductive fingers spaced apart in said second direction.

9. An inkjet print head as defined in claim 1 further comprising a droplet assistor coupled to the body of ink in said nozzle for lowering an amount of energy necessary for an ink droplet to form and separate from the body of ink.

10. An inkjet print head as defined in claim 9, wherein said droplet assistor includes a heater disposed near said nozzle outlet for applying a heat pulse to ink in said nozzle to lower surface tension in said ink meniscus.

11. A method for applying a mechanical force for emitting micro-droplets from a print head nozzle outlet, said method comprising:

supplying a body of liquid ink through a channel to the nozzle outlet; and using a micro-actuator, applying a mechanical force to a member in the channel to move the member in a direction toward the nozzle outlet for causing an ink droplet to separate from said body of ink, said micro-actuator comprising:

a body of deformable elastomer material having opposed first and second surfaces spaced apart in a first direction by a predetermined at-rest dimension, and a charge mechanism coupled to said first opposed surface of said body of deformable elastomer material, said charge mechanism being adapted to apply an electrical charge across said body of deformable elastomer material in said first direction, said charge being spatially varied in a second direction substantially normal to said first direction so as to create spatially varied mechanical forces across the body of deformable elastomer material such that said body of deformable elastomer material exhibits spatially varied growth in said first direction, said member being associated with the second opposed surface of the body of deformable elastomer material so as to move in said first direction in response to growth of the body of deformable elastomer material.

* * * * *